United States Patent [19]

Arnold

[11] 4,341,382

[45] Jul. 27, 1982

[54] INFLATABLE BALL AND VALVE SEALING DEVICE

[76] Inventor: Michael C. Arnold, 224 Charles, Ann Arbor, Mich. 48104

[21] Appl. No.: 116,940

[22] Filed: Jan. 30, 1980

[51] Int. Cl.[3] ..... A63B 41/00; A63B 41/12

[52] U.S. Cl. ..... 273/65 C; 273/65 D; 273/61 D; 81/15.7

[58] Field of Search .....: 273/61 D, 65 C, 65 D; 81/15.7; 63/12, 13

[56] References Cited

U.S. PATENT DOCUMENTS

| | | | |
|---|---|---|---|
| 636,517 | 11/1899 | Glidden | 81/15.7 |
| 1,374,741 | 4/1921 | Jensen | 273/65 C |
| 1,518,901 | 12/1924 | Collins et al. | 273/65 C |
| 2,065,121 | 12/1936 | De Laney et al. | 273/65 D |
| 2,642,872 | 6/1953 | Parker | 63/12 X |
| 3,107,683 | 10/1963 | Ochoa | 273/65 C X |
| 3,504,507 | 4/1970 | Ferro | 63/12 |
| 4,031,688 | 6/1977 | Wasserman | 273/61 D X |

*Primary Examiner*—George J. Marlo
*Attorney, Agent, or Firm*—James M. Deimen

[57] ABSTRACT

The invention comprises a pin shaped repair plug for sealing the bladder valve of an inflatable ball such as a football, soccer ball, basketball, etc. The plug is inserted and removed with a special tool. The plug is retained substantially inside the bladder valve with little or no protrusion from the exterior surface of the valve and ball. The plug grips the inside wall of the valve passage frictionally. The gripping action is sufficient to prevent dislodgment of the plug despite the most demanding use of the ball. As an example, the plug was tested for a full season of practice including punting by a college level football team.

The plug is substantially cylindrical in shape with either an externally or an internally threaded head integrally formed thereon. The tool for inserting and removing the plug from the bladder valve includes either a complementary internally threaded or externally threaded end attachable to the plug head. The internally threaded version of the tool includes an external bevel or chamfer tapering from the outside diameter of the tool to the end of the tool. The bevel or chamfer on the tool assists in separating the bladder valve wall from the threaded end of the externally threaded plug.

5 Claims, 5 Drawing Figures

INFLATABLE BALL AND VALVE SEALING DEVICE

BACKGROUND OF THE INVENTION

The field of the invention comprises inflatable balls used in a variety of sports such as football, basketball, soccer, etc. In particular, the invention pertains to the bladder valve used to inflate and reinflate such a ball.

Typically, such inflatable balls are constructed with an outer leather or vinyl cover and an internal rubber air bladder. The bladder includes a rubber valve that is opened by a hollow needle inserted to inflate the ball. The valve closes or reseals as the hollow needle is withdrawn. Such valves are disclosed in U.S. Pat. No. 2,731,028. Other types of bladder valves are disclosed in U.S. Pat. Nos. 2,349,463, 2,387,433 and 3,107,683.

Unfortunately, bladder valves, being constructed with rubber components, weaken with age and hard usage. The ball then tends to go soft regularly and necessitate replacement at considerable expense before the exterior of the ball is worn out.

SUMMARY OF THE INVENTION

The invention comprises a repair plug for sealing the bladder valve of an inflatable ball such as a football or basketball. The plug is generally pin shaped with an enlarged head. The head may be either externally or internally threaded for engagement with a special insertion and extraction tool. By means of the tool the plug may be inserted with the head of the plug substantially flush to the exterior of the valve and ball. The plug is retained in the valve passage frictionally. Nylon, plastic materials and metal have been found suitable for the pins. The frictional gripping action is sufficient to prevent dislodgment of the plug despite the most demanding use of the ball. As an example, the plug was tested for a full season of practice including punting by a college level football team to assure the effectiveness of the plug.

DESCRIPTION OF THE PREFERRED EMBODIMENTS

Figure 1:
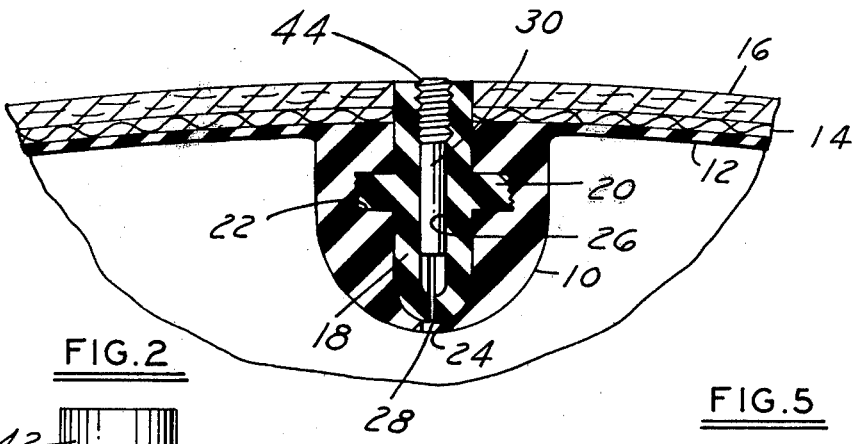
FIG. 1 is a cutaway cross section through an inflatable ball valve showing the plug inserted.

In FIG. 1, a typical bladder valve for a football, basketball, volley ball or similar inflatable ball is shown in cross section. The valve comprises a main body portion 10 formed or molded of rubber with an integral surrounding flange portion 12. The flange 12 is bonded to the internal rubber bladder 14 of the ball. The exterior 16 of the ball is typically leather or vinyl.

Inserted and squeezed within the valve body 10 is a rubber valve insert 18 having a retention flange 20 integral thereto and located within an integral groove 22 in the valve body 10. The insert 18 is commonly formed of a rubber somewhat harder and less flexible than the valve body 10. The valve body 10 includes an aperture 24 and the insert 18 includes a central passage 26 and slot 28 all to permit the insertion of an inflation needle to pump up the ball.

In the normal and proper operation of the bladder valve the squeezing action of the valve body 10 on the insert 18 tightly closes the slot 28 in the insert as the inflation needle is withdrawn from the bladder valve. The retention flange 20 and groove 22 prevent the insert 18 from sliding from the valve body 10 as the needle is withdrawn. With age and hard athletic use, especially in the case of footballs, the bladder valve assembly tends to weaken and the slot 28 no longer fully closes to seal the ball. The ball then tends to go soft during use. Balls that are otherwise serviceable are then discarded with the attendant cost to replace.

Figure 3:
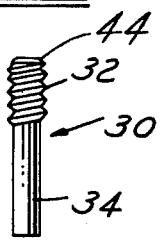
FIG. 3 is a side view of the plug.

As shown in FIG. 1 a plug 30 inserted in the passage 26 of the insert 18. As shown in FIG. 3 the plug 30 is formed with an upper externally threaded portion 32 and smooth round lower portion 34. The plug 30 is inserted completely into the passage 26 approximately flush with the exterior of the bladder valve and the ball as shown in FIG. 1.

Figure 2:
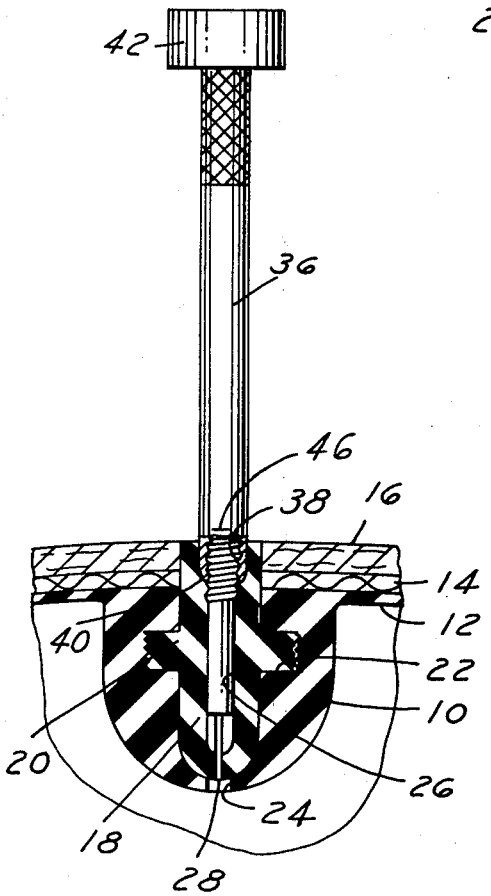
FIG. 2 is a cutaway cross section of the valve showing the plug and insertion tool.

Insertion and removal of the plug 30 is accomplished with the tool 36 shown in FIG. 2. The tool 36 includes an internal threaded socket 38 adapted to engage the threaded portion 32 of the plug 30. The end 40 of the tool 36 is carefully beveled or chamfered to permit smooth insertion into the passage 26.

Insertion is performed by first screwing a plug 30 into the threaded socket 38 until the head of the plug approximately reaches the mark 46 on the outside of the tool 36. The plug is not seated tightly in the tool. The plug 30 is then pushed into the passage 26 until the mark 46 is flush with the exterior of the ball and bladder valve. The tool 36 is then unscrewed from the plug 30. The friction of the plug 30 with the wall of the passage 26 prevents the plug from sliding from the valve when the tool 36 is unscrewed.

If subsequent inflation of the ball is desired, the plug 30 can be removed by screwing the tool 36 onto the threaded portion 32 of the plug. The end chamfer or bevel 40 on the tool 36 assists in moving the wall of the passage 26 away from the threaded portion 32 as the tool is threaded onto the plug. The head 42 permits additional torque and pressure to be applied to the tool 36 during threading. A chamfer 44 on the head of the plug 30 assists in initially threading the tool 36 onto the plug. The combination of the tool chamfer 40 and plug chamfer 44 greatly facilitates the attachment of the tool to the plug when the plug is tightly gripped within a ball valve. A noticeable lessening in the effort required to thread the tool onto the plug will occur when the tool is fully threaded onto the plug. The plug can then be easily pulled from the bladder valve.

Figure 4:
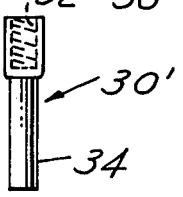
FIG. 4 is a side view of an alternate form of plug.
Figure 5:
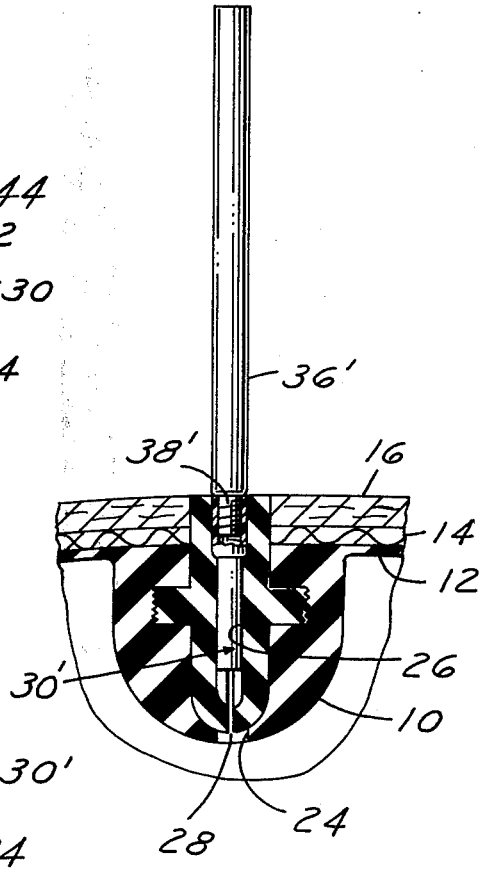
FIG. 5 is a cutaway cross section of the valve and alternate form of the plug and insertion tool.

In FIGS. 4 and 5 an alternate form of the tool 36' and plug 30' is shown. The head of the plug has an internally threaded socket 32' and the tool 36' includes an externally threaded portion 38' adapted to engage the socket 32'. In a similar manner to that disclosed above, the plug 30' is threaded onto the tool 36' and pushed into the passage 26. The tool 36' is then unscrewed from the plug 30'. To extract the plug 30' the procedure is reversed.

Both versions of the plug 30 and 30' have been found to very satisfactorily seal leaking bladder valves. The plug has successfully retained the air in a football used for punting practice for many practice sessions of a top level college football team. In the case of the externally threaded plug 30, the retention of the plug is assisted by the gripping of the threads 32 in the passage wall 26.

I claim:

1. In the combination of a bladder valve extending through the wall of an inflatable ball and a removable plug adapted to seal the bladder valve, the plug comprising a smooth cylindrical body sized to frictionally and sealingly engage the central passage of the bladder valve and a head formed on the body at the upper end thereof, said head including a thread formed thereon.

2. The bladder valve and removable plug of claim 1 wherein the threaded head of the plug includes an internally threaded socket.

3. The bladder valve and removable plug of claim 1 wherein the threaded head of the plug is externally threaded.

4. A tool adapted to insert and remove a removable plug having an externally threaded head from the bladder valve and an inflatable ball, the tool comprising a tubular body, an internally threaded socket at one end of the tool body and an external chamfer on the tool body at the internally threaded end, said external chamfer tapering from the outside diameter of the tool body to the end to assist in moving the wall of the bladder valve passage way from the external thread on the head of the plug.

5. A removable plug and tool combination adapted to seal the bladder valve of an inflatable ball, the plug comprising a smooth cylindrical body sized to frictionally and sealingly engage the central passage of the bladder valve and a head formed on the plug body at the upper end thereof, said head having an external thread thereon, the tool comprising a tubular body, an internally threaded socket at one end of the tool body adapted to engage the external thread on the plug head, and an external chamber on the tool body at the internally threaded end, said external chamfer tapering from the outside diameter of the tool body to the end to assist in moving the wall of the bladder valve passage away from the external thread on the head of the plug.

* * * * *